United States Patent [19]

Carpentier

[11] Patent Number: 4,664,190

[45] Date of Patent: May 12, 1987

[54] PROCESS FOR RECOVERING NATURAL GAS LIQUIDS

[75] Inventor: Philip L. Carpentier, Katy, Tex.

[73] Assignee: Shell Western E&P Inc., Houston, Tex.

[21] Appl. No.: 810,813

[22] Filed: Dec. 18, 1985

[51] Int. Cl.[4] ..... E21B 43/16

[52] U.S. Cl. ..... 166/267; 166/268; 166/302

[58] Field of Search ..... 166/266–268, 166/302

[56] References Cited

U.S. PATENT DOCUMENTS

| | | | |
|---|---|---|---|
| 2,582,148 | 1/1952 | Nelly, Jr. | 166/266 |
| 2,729,291 | 1/1956 | Haverfield | 166/266 |
| 3,100,697 | 8/1963 | Hull | 62/42 |
| 3,116,136 | 12/1963 | Horton et al. | 62/20 |
| 3,228,467 | 1/1966 | Schlinger | 166/266 |
| 3,292,381 | 12/1966 | Bludworth | 62/20 |
| 3,330,124 | 7/1967 | Marshall | 62/20 |
| 3,360,945 | 1/1968 | Thornton et al. | 62/26 |
| 3,442,332 | 5/1969 | Keith | 166/266 |
| 3,995,693 | 12/1976 | Cornelius | 166/268 |
| 4,187,910 | 2/1980 | Cornelius et al. | 166/305 R |
| 4,318,723 | 3/1982 | Holmes et al. | 62/20 |
| 4,417,449 | 11/1983 | Hegart et al. | 62/28 |
| 4,441,900 | 4/1984 | Swallow | 62/29 |
| 4,449,994 | 5/1984 | Hegarty et al. | 62/17 |
| 4,529,037 | 7/1985 | Froning et al. | 166/267 |

*Primary Examiner*—Stephen J. Novosad
*Assistant Examiner*—Bruce M. Kisliuk

[57] ABSTRACT

A process is provided in which carbon dioxide is injected into an oil-containing reservoir as an aid in recovering oil from the reservoir. Oil can be produced from at least one production well in the reservoir and carbon dioxide-containing hydrocarbon gas will be produced with the oil. Heavy ends are stripped from the carbon dioxide-containing hydrocarbon gas and substantially all of the carbon dioxide in reinjected into the oil-containing reservoir.

10 Claims, 1 Drawing Figure

PROCESS FOR RECOVERING NATURAL GAS LIQUIDS

BACKGROUND OF THE INVENTION

It has become increasingly economical to employ enhanced oil recovery techniques for recovering heavy crude oil. One particularly advantageous enhanced recovery method is the injection of high pressure gaseous carbon dioxide into an oil well. This procedure takes advantage of the high solubility of carbon dioxide in crude oil, together with the fact that the viscosity of the crude oil-carbon dioxide solution is significantly lower than the crude oil alone. Consequently, even heavy crude oils can be recovered by injecting gaseous carbon dioxide into a subterranean formation in an amount sufficient to saturate the contained oil, followed by the withdrawal of the low viscosity crude oil-carbon dioxide solution from the formation.

One consequence of this particular enhanced recovery technique, however, is that the gaseous phase recovered at the wellhead is contaminated with carbon dioxide. Since this carbon dioxide disadvantageously reduces the value of the recovered natural gas mixture, it is normally removed prior to further use of the natural gas. At present, a variety of separation techniques are available for this purpose.

A process currently practiced for removing carbon dioxide from gas streams is by physical or chemical washing or absorption. Solvents commonly used for these procedures include methanol, amines, propylene carbonate, potassium carbonate and N-methyl pyrolidone. With the absorption approach, operating expenses are strongly influenced by the concentration of carbon dioxide in the gas stream to be treated. As the carbon dioxide concentration in the gas stream increases, the costs associated with replacement of the absorption fluids increases significantly.

Another process, involving adsorption systems, has been used to remove carbon dioxide from gas streams. However, besides being burdened with substantial irreversible energy losses, such systems are also generally limited to the removal of small quantities of carbon dioxide from gas streams because of economic considerations.

Yet another process employs cryogenic processing techniques. At low carbon dioxide concentrations, advantage is taken of the relatively high freezing point of carbon dioxide relative to the freezing point of other gases with which it is normally found in admixtures, by allowing carbon dioxide to selectively freeze out or plate onto heat transfer surfaces; with the subsequent removal therefrom by flowing an essentially carbon dioxide-free gas stream thereover on a subsequent cycle. Unfortunately, at high carbon dioxide concentrations, the freezing carbon dioxide may plug process piping and equipment, rendering the entire system inoperable.

Accordingly, the present invention is directed toward a new technique for economically separating the carbon dioxide from valuable hydrocarbons and then reinjecting the carbon dioxide into the subterranean formation, which avoids the above noted problems of the art.

Applicant is not aware of any prior art references which, in his judgment as one skilled in the carbon dioxide flooding art, would anticipate or render obvious the novel process of the instant invention; however, for the purposes of fully developing the background of the invention and establishing the state of the requisite art, the following are set forth: U.S. Pat. Nos. 4,441,900; 3,995,693; 4,187,910; 3,100,697; 3,116,136; 3,330,124; 4,449,994; 4,318,723; 3,360,945; 3,292,381; 4,417,449.

SUMMARY OF THE INVENTION

Figure 1:
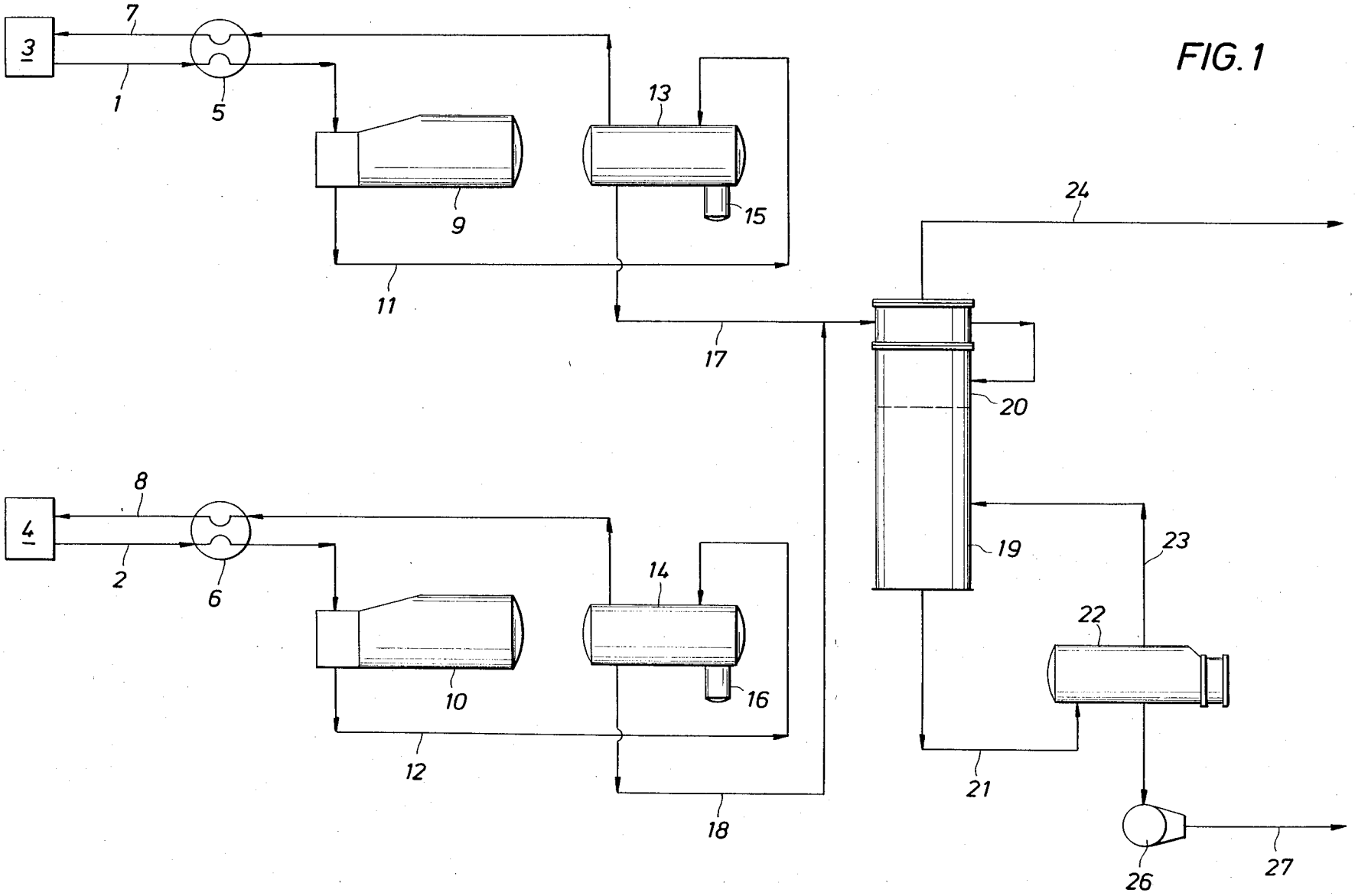
FIG. 1 is a block flow diagram showing the integration of the present invention into an overall carbon dioxide injection system for producing an oil containing underground reservoir.

A purpose of this invention is to provide an economical process for separating hydrocarbon heay ends from a carbon dioxide-containing hydrocarbon gas mixture.

Yet another purpose of this invention is to provide an economical process for producing an oil containing underground reservoir by injecting carbon dioxide into said oil, producing both the oil and the carbon dioxide, and then economically reinjecting substantially all of the carbon dioxide back into the field.

Accordingly, these and other purposes of the invention are realized by the present process for treatng an underground reservoir containing heavy hydrocarbons, particularly crude oil, using carbon dioxide by injecting the carbon dioxide into at least one well in the oil containing reservoir, thereby dissolving at least some carbon dioxide into said oil; producing oil from at least one production well in said reservoir other than the injection well; producing carbon dioxide-containing hydrocarbon gas from at least one well in the reservoir other than said injection well; chilling said carbon dioxide-containing hydrocarbon gas and removing at least substantially all of $C_{5+}$ hydrocarbons therefrom; and reinjecting substantially all of said carbon dioxide and remaining hydrocarbon gas into sais oil containing reservoir. In a more preferred embodiment of the invention there are included the steps of fractionating said $C_{5+}$ hydrocarbons to remove substantially all carbon dioxide therefrom, and combining the removed carbon dioxide with the other said carbon dioxide and remaining hydrocarbon gas to be reinjected.

Other purposes, advantages and features of the invention will be apparent to one skilled in the art upon review of the following:

DESCRIPTION OF PREFERRED EMBODIMENTS

The present invention comprises an improved separation process for reinjecting large quantities of carbon dioxide from a carbon dioxide-hydrocarbon gas mixture into an oil-containing reservoir. This invention is particularly useful for treating the gas fraction recovered from an oil well practicing carbon dioxide injection as an enhanced recovery technique. The invention may also find application in treating other naturally occurring gas wells having high quantities of carbon dioxide. In particular, the invention can be used to reinject carbon dioxide from a carbon dioxide-hydrocarbon gas mixture containing a widely varying percentage of carbon dioxide. This invention allows the art to realize the advantages of utilizing a carbon dioxide flood as an enhanced recovery technique while producing and reinjecting the carbon dioxide in an economical manner.

In accordance with the present invention carbon dioxide contaminated gas, such as carbon dioxide flood gas, is processed at the location of the oil and gas wells. This avoids the costs of transporting the entire contaminated gas to a gas plant, which may be quite some distance away. Further, unlike the above discussed prior art, the present invention does not seek to secure pure carbon dioxide. Instead, the present invention is directed at stripping valuable hydrocarbon heavy ends from the carbon dioxide contaminated gas. The heavy ends usually constitute only a minor portion of the gas, e.g., 1–2% $C_{5+}$ and 1–2% $C_4$, and lighter ends constitute a greater portion, e.g. 3–5% $C_3$5–10% $C_2$ and 18–51% $C_1$. The remainder is primarily carbon dioxide, e.g., 30–72% $CO_2$, most of which is reinjected into the oil-bearing formation after heavy ends have been removed. For example, typically less than 1% of the carbon dioxide is passed on with heavy ends after an initial chilling and separation is performed, as hereinafter described. And, a subsequent fractionation removes substantially all of the carbon dioxide from the heavy ends, and this subsequently removed carbon dioxide may likewise be reinjected into the oil-bearing formation, also as hereinafter described.

The use of this invention in connection with a carbon dioxide enhanced oil recovery/injection system is illustrated in the block flow diagram of FIG. 1. A mixture of gas comprising hydrocarbons and carbon dioxide is taken via lines 1 and 2 from gas production from production fields 3 and 4. An exemplary composition in line 2 would be 30% $CO_2$ and 10% $C_2$, 5% $C_3$2% $C_4$ and 2% $C_{5+}$ hydrocarbons at 120° F. and 260 psig, more or less. An exemplary composition in line 1 would be 72% $CO_2$ and 18% $C_1$, 5% $C_2$, 3% $C_3$, 1% $C_4$ and 1% $C_{5+}$ hydrocarbons at 120° F. and 260 psig, more or less. After streams 1 and 2 have been treated, for example by dehydration and pressurization, each is passed through a gas-gas exchanger, units 5 and 6 respectively, where each is heat exchanged with streams 7 and 8, respectively which are being passed back to the production fields 3 and 4. Streams 1 and 2 are then passed into chillers 9 and 10, respectively, and cooled, for example by Freon 22, to a temperature of for example, −15° F. more or less. Gaseous/liquid streams 11 and 12 are then removed from chillers 9 and 10, respectively, and passed into gas/liquid separation vessels 13 and 14, respectively, whereat water and dehydration chemicals, for example triethylene glycol, are removed in sumps 15 and 16 and heavy hydrocarbons are removed via lines 17 and 18, respectively. Streams 7 and 8, as above mentioned, contain substantially the identical quantity of carbon dioxide as admitted to the tanks 13 and 14, respectively, and are at a temperature of, for example −15° F., more or less, and a pressure of 250 psig, more or less. Streams 17 and 18 preferably are combined and passed into a fractionation column 19 which is operated in accordance with techniques known to the art. Alternatively, streams 17 and 18 could be fractionated separately or one could be left unfractionated. Column 19 has a reflux condenser (heat exchanger) 20 which reentrains liquid back into the liquid column, which is operated as follows. Cold liquid entering the fractionation column first passes into the reflux condenser. Vapors rising in the fractionation column exchange heat with the liquid stream at the reflux condenser, causing liquids to condense from the vapor. Liquid bottom stream 21 is passed into a reboiler 22 and resulting gaseous stream 23 is readmitted into the lower part of column 19. The reboiler is preferably heated by a stream 24 which may be taken, for example, from compressors utilized to recompress streams 7 and 8 prior to reinjecting them into the oil reservoir(s). Gaseous overhead stream 24 is removed from distillation column 19. This stream is, for example, 52% $CO_2$ and 9% $C_1$, 16%, $C_2$, 16% $C_3$, 6% $C_4$ and 1% $C_{5+}$ hydrocarbons and may be combined with streams 7 and 8 and returned to the field or alternatively may be compressed and combined with streams 1 and/or 2 and returned to the process inlet. Heavy ends stream 25 is, for example, 20% propane and 80% natural gasoline, by volume, and is passed via a pump 26 and line 27 to a gas plant for further processing. Stream 27 is for example 350 BBL/D where stream 1 is 10 MMCFD and stream 2 is 10 MMCFD.

The foregoing description of the invention is merely intended to be explanatory thereof. Process conditions are merely exemplary and may vary around the specific preferred figures given. Also, % refers to mol %, unless otherwise indicated, and $C_2$, $C_3$ etc. refer to the number of carbon atoms in hydrocarbon molecules. Various changes in the details of the described process and apparatus may be made within the scope of the appended claims without departing from the spirit of the invention.

What is claimed is:

1. A process for treating an oil-containing underground reservoir using carbon dioxide comprising:

injecting carbon dioxide into at least one well in the oil-containing underground reservoir, thereby dissolving at least some carbon dioxide into said oil;

producing oil from at least one production well in said reservoir other than the injection well;

producing carbon dioxide containing hydrocarbon gas from at least one well in said reservoir other than said injection well;

chilling said carbon dioxide-containing hydrocarbon gas and removing at least substantially all of $C_{5+}$ hydrocarbons therefrom;

fractionating said $C_{5+}$ hydrocarbons to remove substantially all carbon dioxide therefrom;

compressing said carbon dioxide and remaining hydrocarbon gas prior to reinjecting into said oil-containing reservoir, and using a part of the compressed gas to supply heat to said fractionating; and reinjecting substantially all of said carbon dioxide and remaining hydrocarbon gas into said oil-containing reservoir.

2. The process of claim 1 wherein the carbon dioxide removed by fractionating is combined with said carbon dioxide and remaining hydrocarbon gas to be reinjected.

3. The process of claim 1 wherein the carbon dioxide removed by fractionating is compressed and combined with said carbon dioxide-containing hydrocarbon gas to be processed.

4. The process of claim 1 including removing some $C_4$ hydrocarbons, a minor amount of $C_3$hydrocarbons and substantially no $C_2$ hydrocarbons from said carbon dioxide containing hydrocarbon gas.

5. The process of claim 1 wherein said carbon dioxide is produced from an oil well.

6. The process of claim 1 wherein said carbon dioxide is produced from a gas well.

7. A process for treating an oil-containing underground reservoir using carbon dioxide comprising:

injecting carbon dioxide into at least one well in the oil-containing underground reservoir, thereby dissolving at least some carbon dioxide into said oil;

producing oil from at least one production well in said reservoir other than the injection well;

producing carbon dioxide-containing hydrocarbon gas from at least one well in said reservoir other than said injection well;

chilling said carbon dioxide-containing hydrocarbon gas and removing at least substantially all of $C_{5+}$ hydrocarbons therefrom; and reinjecting substantially all of said carbon dioxide and remaining hydrocarbon gas into said oil-containing reservoir after heat exchanging said carbon dioxide and remaining hydrocarbon gas with the carbon dioxide-containing gas produced from said at least one well.

8. A process for treating an oil-containing underground reservoir using carbon dioxide comprising:

injecting carbon dioxide into at least one well in the oil-containing underground reservoir, thereby dissolving at least some carbon dioxide into said oil;

producing oil from at least one production well in said reservoir other than the injection well;

producing carbon dioxide-containing hydrocarbon gas from at least one well in said reservoir other than said injection well;

chemically dehydrating and pressurizing said carbon dioxide-containing gas;

chilling said carbon dioxide-containing hydrocarbon gas;

removing water and dehydration chemical from the chilled carbon dioxide-containing hydrocarbon gas;

removing at least substantially all of $C_{5+}$ hydrocarbons from the chilled carbon dioxide-containing hydrocarbon gas; and reinjecting substantially all of said carbon dioxide and remaining hydrocarbon gas into said oil-containing reservoir.

9. A process for treating an oil-containing underground reservoir using carbon dioxide comprising:

injecting carbon dioxide into at least one well in the oil-containing underground reservoir, thereby dissolving at least some carbon dioxide into said oil;

producing oil from at least one production well in said reservoir other than the injection well;

producing carbon dioxide-containing hydrocarbon gas from at least one well in said reservoir other than said injection well;

chemically dehydrating and pressurizing said carbon dioxide-containing gas;

chilling said carbon dioxide-containing hydrocarbon gas;

removing water and dehydration chemical from the chilled carbon dioxide-containing hydrocarbon gas;

removing at least substantially all of $C_{5+}$ hydrocarbons from the chilled carbon dioxide-containing hydrocarbon gas; and reinjecting substantially all of said carbon dioxide and remaining hydrocarbon gas into said oil-containing reservoir after heat exchanging said carbon dioxide and remaining hydrocarbon gas with the carbon dioxide-containing gas produced from said at least one well.

10. A process for treating an oil-containing underground reservoir using carbon dioxide comprising:

injecting carbon dioxide into at least one well in the oil-containing underground reservoir, thereby dissolving at least some carbon dioxide into said oil;

producing oil from at least one production well in said reservoir other than the injection well;

producing carbon dioxide-containing hydrocarbon gas from at least one well in said reservoir other than said injection well;

chemically dehydrating and pressurizing said carbon dioxide-containing gas;

chilling said carbon dioxide-containing hydrocarbon gas;

removing water and dehydration chemical from the chilled carbon dioxide-containing hydrocarbon gas;

removing at least substantially all of $C_{5+}$ hydrocarbons from the chilled carbon dioxide-containing hydrocarbon gas;

fractionating said $C_{5+}$ hydrocarbons to remove substantially all carbon dioxide therefrom;

compressing said carbon dioxide and remaining hydrocarbon gas prior to reinjecting into said oil-containing reservoir, and using a part of the compressed gas to supply heat to said fractionating; and reinjecting substantially all of said carbon dioxide and remaining hydrocarbon gas into said oil-containing reservoir after heat exchanging said carbon dioxide and remaining hydrocarbon gas with the carbon dioxide-containing gas produced from said at least one well.

* * * * *